US006687334B2

(12) United States Patent
Galish et al.

(10) Patent No.: US 6,687,334 B2
(45) Date of Patent: Feb. 3, 2004

(54) X-RAY COLLIMATOR AND METHOD OF CONSTRUCTION

(75) Inventors: Andrew Joseph Galish, West Chester, OH (US); Dean Frederick Graber, Hamilton, OH (US); Douglas Edward Ingram, Cincinnati, OH (US); Francis Howard Little, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 38 days.

(21) Appl. No.: 10/161,463

(22) Filed: May 31, 2002

(65) Prior Publication Data

US 2003/0223548 A1 Dec. 4, 2003

(51) Int. Cl.[7] ..... G21K 1/02
(52) U.S. Cl. ..... 378/147; 378/149
(58) Field of Search ..... 378/147, 149; 250/505.1

(56) References Cited

U.S. PATENT DOCUMENTS

| | | | | |
|---|---|---|---|---|
| 4,429,227 | A | 1/1984 | DiBianca et al. | 250/367 |
| 4,563,584 | A | 1/1986 | Hoffman et al. | 250/368 |
| 4,710,947 | A | 12/1987 | Klein | 378/147 |
| 5,131,021 | A | 7/1992 | Gard et al. | 378/19 |
| 5,487,098 | A | 1/1996 | Dobbs et al. | 378/19 |
| 5,965,893 | A | 10/1999 | Tonami et al. | 250/370.11 |
| 5,991,357 | A | 11/1999 | Marcovici et al. | 378/19 |
| 6,055,296 | A | 4/2000 | Ferlic et al. | 378/154 |
| 6,137,857 | A | 10/2000 | Hoffman et al. | 378/19 |
| 6,181,767 | B1 | 1/2001 | Harootian | 378/19 |

*Primary Examiner*—Craig E. Church
*Assistant Examiner*—Jurie Yun
(74) *Attorney, Agent, or Firm*—V G Ramaswamy; Pierce Atwood

(57) ABSTRACT

A collimator for an X-ray inspection apparatus is provided comprising a carrier having a planar top surface; an arcuate base disposed on the carrier, comprising at least one arcuate bar section made from a radio-opaque material; and a plurality of radio-opaque collimator plates disposed on the arcuate base in a radial array with a bottom edge of each collimator plate in contact with the top surface of the arcuate base. A method for assembling such a collimator is also provided, as well as an alignment fixture useful for practicing the described method. The described structure, method, and alignment fixture permit the construction of large collimator assemblies while maintaining precision and minimizing cost.

17 Claims, 7 Drawing Sheets

X-RAY COLLIMATOR AND METHOD OF CONSTRUCTION

BACKGROUND OF THE INVENTION

This invention relates generally to X-ray inspection systems and more particularly to collimators for such systems.

It is known to use linear detectors with X-ray inspection systems for industrial parts. Linear detectors can provide improved contrast resolution and are thus well suited for digital radiography (DR) and computed tomography (CT). Improved contrast resolution is achieved by the use of x-ray collimation, which reduces the contribution of scattered X-rays to the resulting image. Ideally, the x-ray detector is horizontally collimated to provide rejection of in-plane scatter. This horizontal collimation generally takes the form of an array of tungsten plates radially aligned about the x-ray focal spot, placed in front of the x-ray detector elements. This presents a horizontal aperture for each detector element. The precision and uniformity of this structure strongly affects image quality. Large collimation arrays (in both length and depth) are required to inspect large or dense parts. Because of the limitations of prior art manufacturing and assembly methods, the difficulty of construction and hence the cost of high precision, high uniformity collimation arrays increases as the physical size of the array increases.

Accordingly, there is a need for a collimator for high energy X-ray inspection systems that can be readily manufactured at any size, while preserving precision and uniformity and minimizing complexity and cost.

BRIEF SUMMARY OF THE INVENTION

The above-mentioned need is met by the present invention, which provides in one aspect a collimator comprising a carrier having a planar top surface; an arcuate base disposed on the carrier, comprising at least one arcuate bar section made from a radio-opaque material. The bar sections include a plurality of parallel grooves formed in inner and outer edges thereof. A plurality of radio-opaque collimator plates are disposed on the arcuate base in a radial array with a bottom edge of each collimator plate in contact with the top surface of the arcuate base. First and second alignment tabs extend downward from the bottom edges of the collimator plates and engage the grooves formed in the edges of the bar sections.

In another aspect, the present invention provides a method for assembling a collimator including the steps of: providing a carrier having a planar top surface; providing an arcuate base disposed on the top surface of the carrier, the arcuate base comprising one or more arcuate bar sections having a plurality of parallel grooves formed in inner and outer edges thereof; providing a plurality of radio-opaque collimator plates, each of said plates being generally rectangular and having first and second alignment tabs extending downward from a bottom edge thereof; disposing the collimator plates on the arcuate base with the alignment tabs fitting into the grooves in the arcuate base, such that the collimator plates are positioned in a radial array with respect to said arcuate base, and the bottom edge of each collimator plate is in contact with the top surface of the arcuate base; aligning the collimator plates perpendicular to the top surface of the arcuate base; and securing the collimator plates thereto.

In yet another aspect of the present invention, an alignment fixture is provided for assembling a collimator having a radial array of plates disposed on an arcuate base. The alignment fixture includes a body having a plurality of ribs formed on its bottom surface for engaging the array of collimator plates. The ribs are arranged in a radial pattern corresponding to a desired arrangement of the collimator plates. The alignment fixture includes means for positioning the alignment fixture in a circumferential direction with respect to said arcuate base.

The present invention and its advantages over the prior art will become apparent upon reading the following detailed description and the appended claims with reference to the accompanying drawings.

BRIEF DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
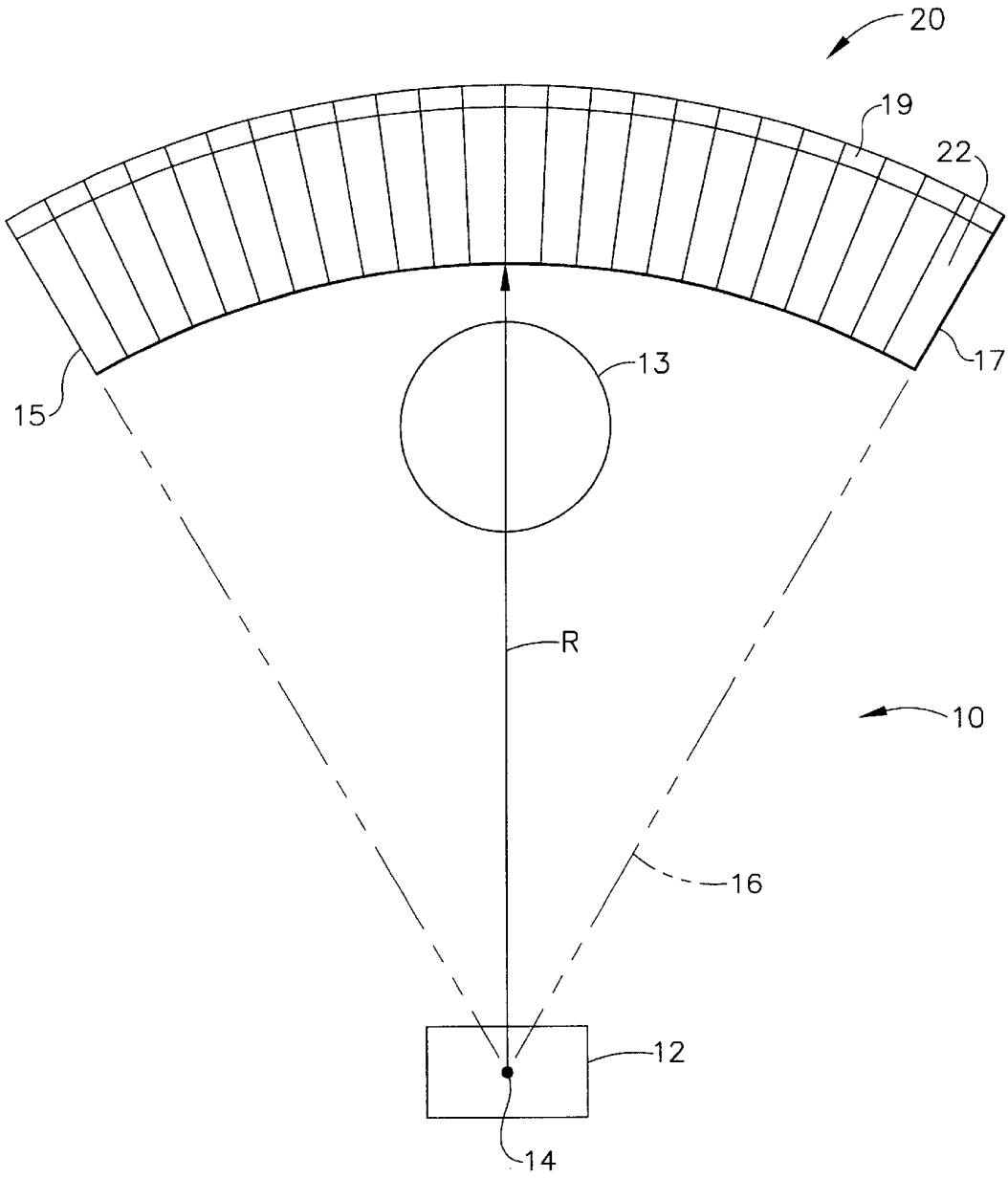
FIG. 1 is a schematic top view of an X-ray inspection system.

Referring to the drawings wherein identical reference numerals denote the same elements throughout the various views, FIG. 1 shows an schematic top view of an X-ray inspection system 10. The system 10 includes an X-ray source 12 which produces a fan-shaped X-ray beam 16 having its center at the focal spot 14 of the source 12. An arc-shaped detector assembly 20 receives the X-ray radiation after it passes through a target 13.

The X-ray source 12 may be any known X-ray source which is capable of producing X-rays having the energy level required for the particular application. The collimator assembly of the present invention is especially useful in high-energy applications, that is applications having an output of about 1 MeV or higher. One suitable X-ray source is a Linatron M6 linear accelerator of 6 MeV output, available from Varian Industrial Products, 3100 Hansen Way, Palo Alto, Calif., 84104 USA.

Figure 2:
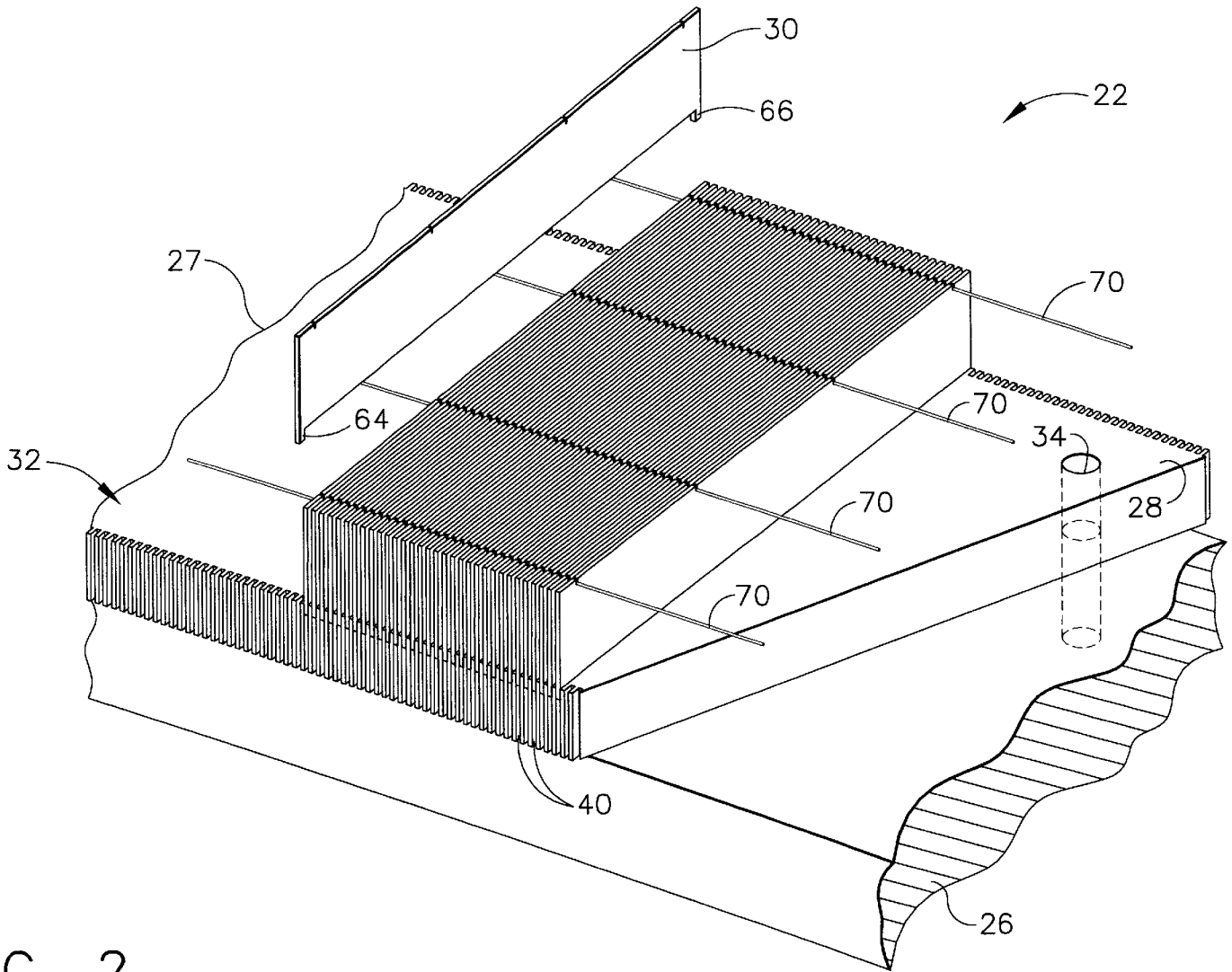
FIG. 2 is a perspective view of a portion of a collimator assembly constructed in accordance with the present invention.

The detector assembly 20 includes an X-ray detector 19, for example a linear array detector 19, and a collimator assembly 22. Referring to FIG. 2, the collimator assembly 22 generally comprises a carrier 26, an arcuate base 27 including a plurality of radio-opaque arcuate bar sections 28, and a plurality of radio-opaque collimator plates 30 arranged in a radial array. It is noted that, as used herein, the term "radial" means a direction parallel to a line extending from the focal spot 14 of the X-ray source 12. An example of one such line is line labeled R in FIG. 1. Also, as used herein, the term "circumferential" means a direction along the arc between first and second ends 15 and 17 of the detector assembly 20 (in other words, tangent to a line extending from the focal spot 14 of the X-ray source 12). One or more wires 70 may also be used to stabilize and align the collimator plates 30, as described below.

The carrier 26 is an arc-shaped structure which provides a unified foundation for the collimator assembly 22. In the illustrated example the carrier 26 is constructed of steel plate, although other materials could be used. The carrier 26 has a generally planar top surface 32 which receives the bar sections 28 that constitute the arcuate base 27 and includes means for aligning the bar sections 28, such as dowel pins 34 which fit into holes in the carrier 26 and corresponding holes 33 in the bar sections 28.

Figure 3:
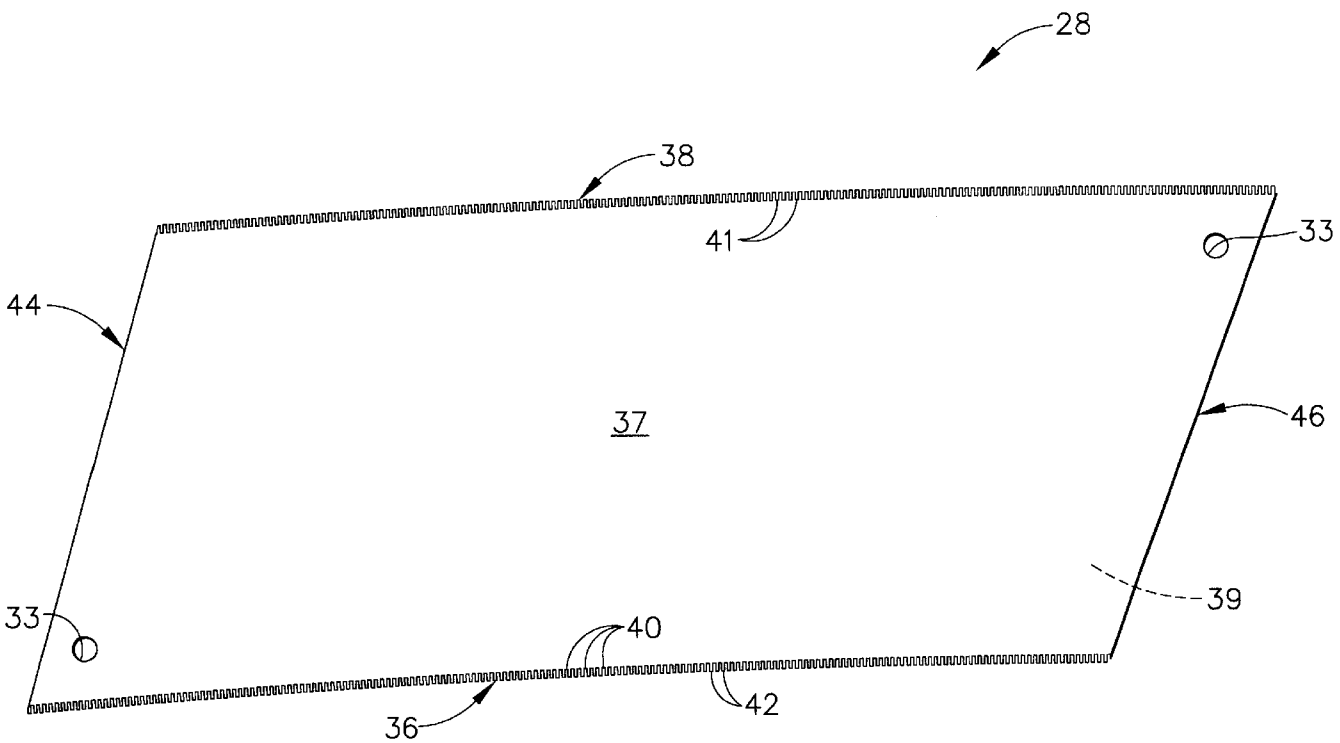
FIG. 3 is top view of a bar section for use with the collimator assembly of the present invention.

FIG. 3 shows a top view of an exemplary bar section 28. Each bar section 28 is a plate which is arcuate in plan view and comprises a radio-opaque material such as tungsten. In the illustrated example the bar section 28 is about 12 mm (0.47 in.) thick. The bar section 28 has an arcuate inner edge 36 and an arcuate outer edge 38. The distance between the inner edge 36 and the outer edge 38 (i.e. the depth) is selected to be sufficient to stop the beam 16 from passing through the bar section 28. This protects the active elements of the detector array 19, which are mounted behind the bar sections 28, from direct exposure to X-rays. The actual depth depends upon the output of the X-ray source 12 used in the particular application. In the illustrated example the curve of the inner edge 36 has a radius of about 235 cm (93 in.), while the curve of the outer edge 38 has a radius of about 244 cm (96 in.) A plurality of parallel slots 40 are formed in the inner edge 36, extending vertically between the top and bottom surfaces 37 and 39 of the bar section 28. The width of the slots 40 are approximately equal to the thickness of the collimator plates 30 (described below), while the lands 42 separating the slots 40 are of about the same width as the slots 42. In the illustrated example the slot and land width is about 0.5 mm (0.02 in.) A similar plurality of parallel slots 41 is formed in the outer edge 38. The slots in the inner and outer edges are positioned and spaced so that when the collimator plates 30 are mounted on the bar sections 28, each of the collimator plates 30 will be aligned along a radial line extending from the focal spot 14 of the X-ray source 12. Each of the bar sections 28 has first and second circumferential edges 44 and 46 which abut the adjoining bar sections on either side. The circumferential edges are disposed at an angle such that the joints between adjacent bar sections 28 are not parallel to a radial line extending from the focal spot 14 of the X-ray source 12. This prevents X-rays from having a straight line path of travel between the adjacent bar sections 28. Each of the bar sections 28 includes one or more holes 33 for receiving means for aligning the bar sections 28 during machining and during assembly to the carrier 26, such as dowel pins 34 (see FIG. 2).

Figure 4:
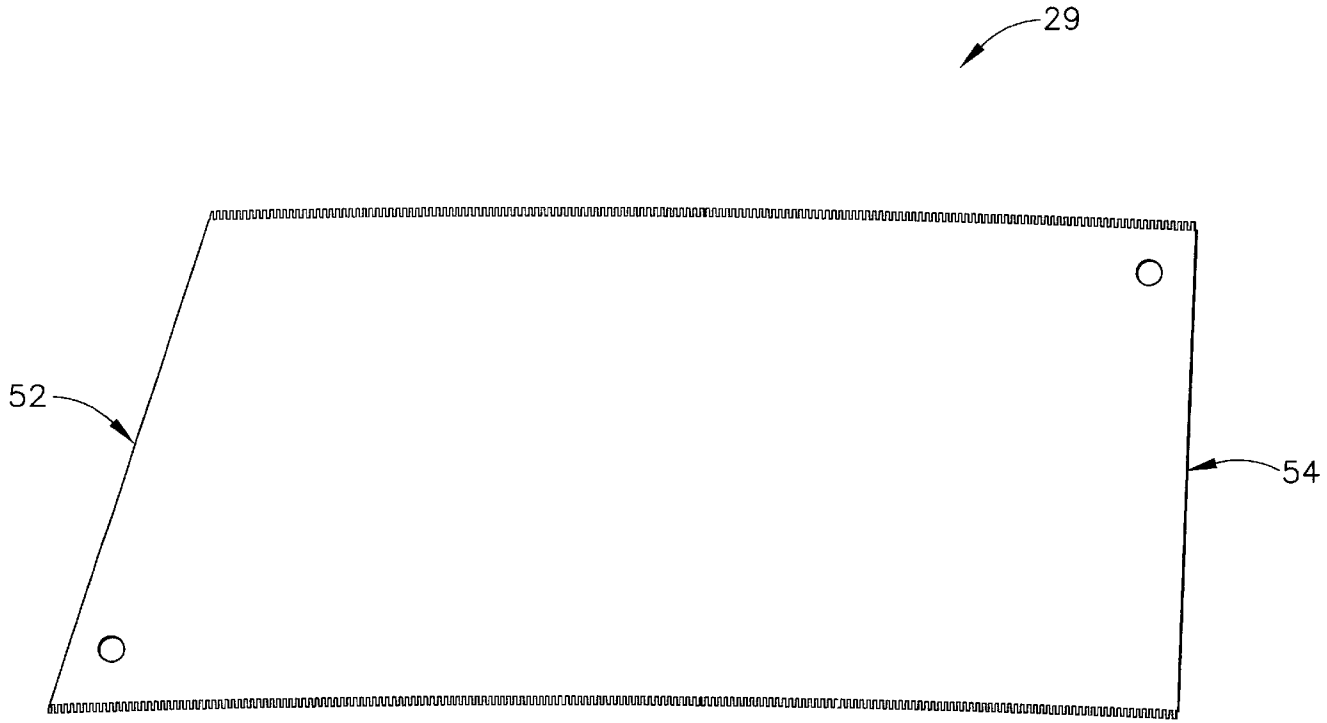
FIG. 4 is top view of a bar section configured as an end plate for use with the collimator assembly of the present invention.

The bar section 28 located at each circumferential end of the collimator assembly 22 is configured as an end plate 29 (see FIG. 4). Each of the end plates 29 includes one edge 52 which is disposed at an angle so as to mate with the adjacent bar section 28, and a second edge 54 which is radially aligned with respect to the base 27. The end plates 29 are otherwise identical to the other bar sections 28.

Figure 5:
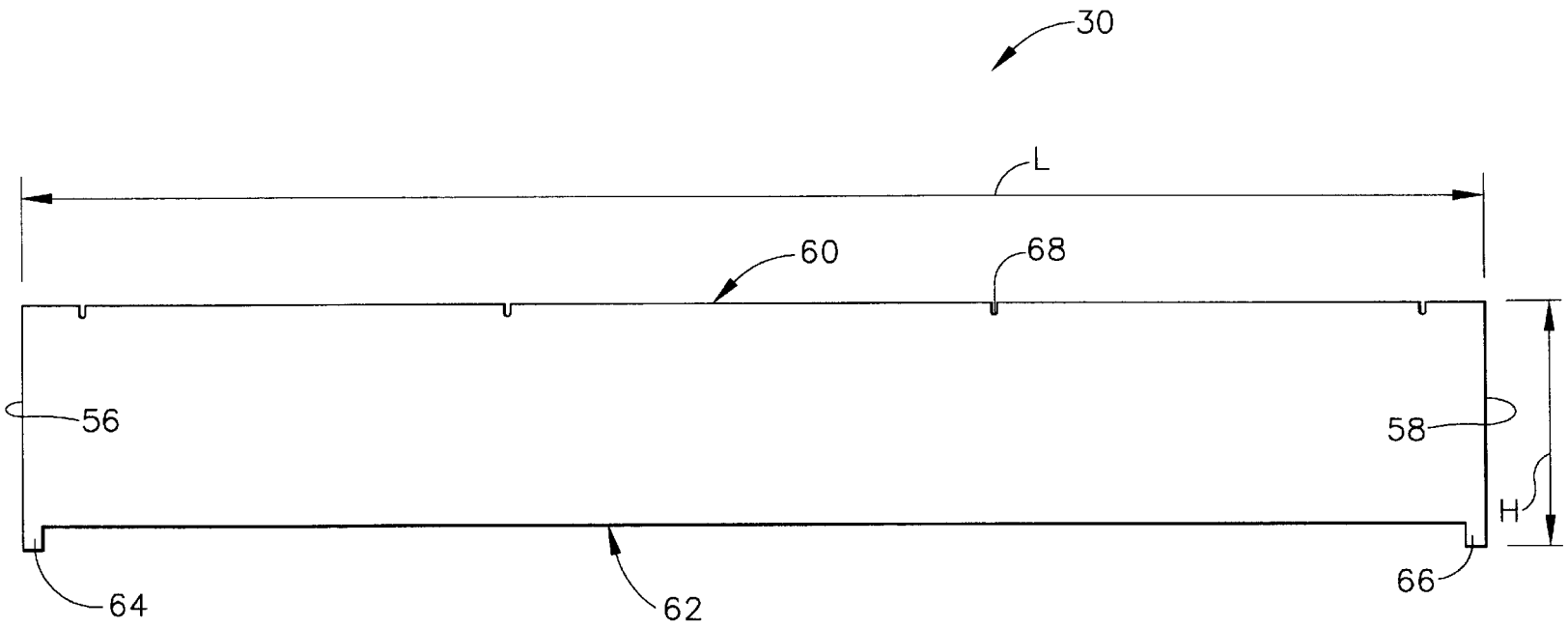
FIG. 5 is a side view of a collimator plate for use with the collimator assembly of the present invention.

An exemplary collimator plate 30 is illustrated in FIG. 5. The collimator plate 30 has spaced-apart inner and outer edges 56 and 58 and spaced-apart upper and lower edges 60 and 62. A first alignment tab 64 extends downward from the corner formed by the inner edge 56 and the lower edge 62. A second alignment tab 66 extends downward from the corner formed by the outer edge 58 and the lower edge 62. A plurality of notches 68 are formed in the upper edge 60 for receiving wires 70 (described below). The notches 68 are shown with exaggerated dimensions in FIG. 5 for clarity. In the illustrated embodiment, the collimator plate 30 has a length L of about 76 mm (3 in.), a height H of about 12 mm (0.47 in.), and a thickness of about 0.5 mm (0.02 in.). These dimensions are related to the dimensions of the particular detector array 19 used and the power of the X-ray source 12, and may be varied to suit a particular application.

The wires 70 (short sections of which are shown in FIG. 2) serve to stabilize and align the upper edges 60 of the collimator plates 30. Each of the wires 70 extends continuously from one circumferential end 15 of the detector assembly 20 to the other circumferential end 17. The wires 70 span the spaces between the collimator plates 30 and are received in the corresponding notches 68 of each adjacent collimator plate 30. The wires 70 are secured to the collimator plates 30, for example with an adhesive, and therefore prevent relative movement of the collimator plates 30. In the illustrated embodiment, the wires 70 are made of tungsten. The wires 70 are of a rectangular cross-section to increase the surface area available for the adhesive, with dimensions of about 0.27 mm (0.011 in.) by about 0.43 mm (0.017 in.)

Figure 6:
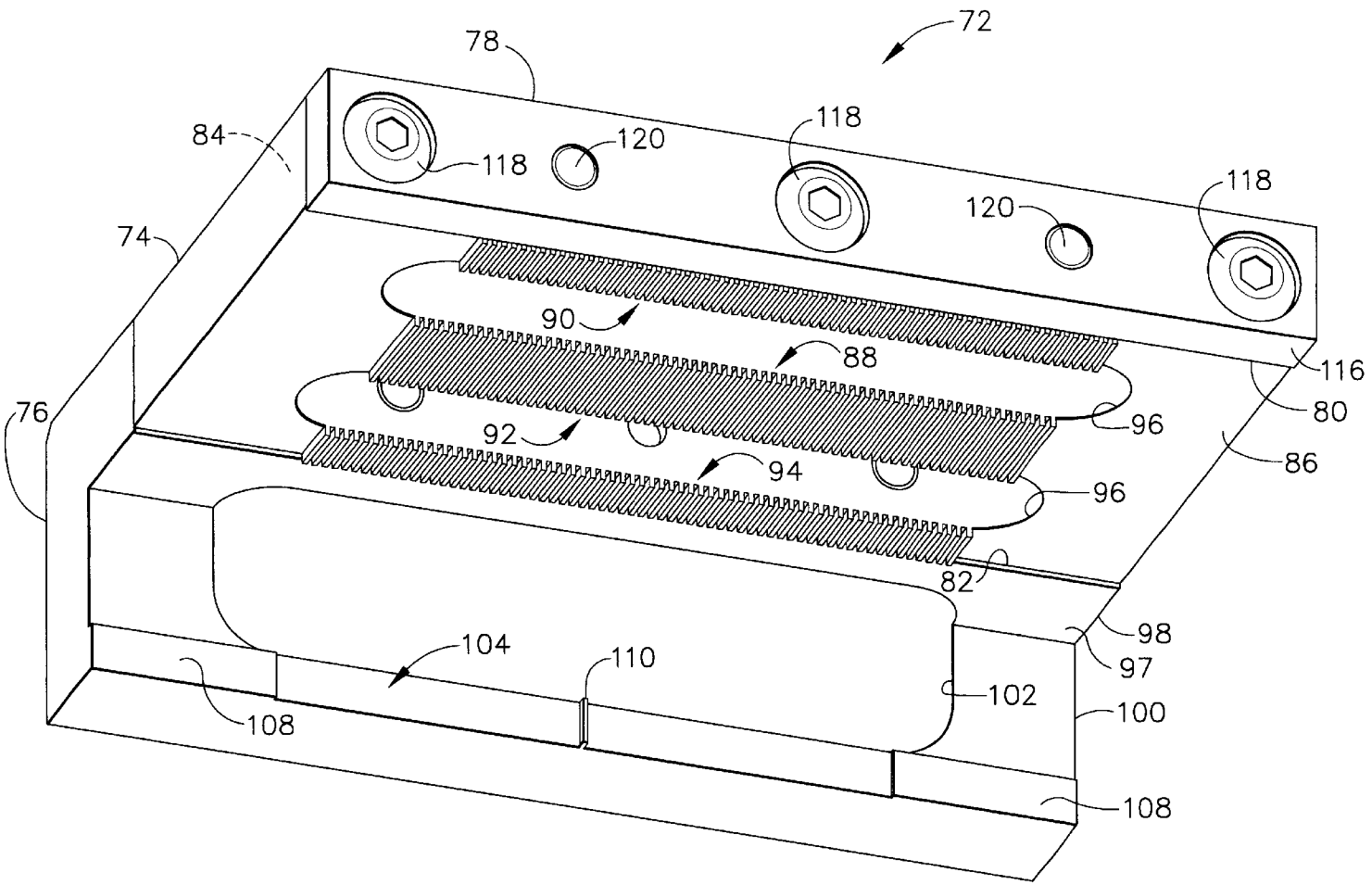
FIG. 6 is a perspective view of the underside of an alignment fixture suitable for assembling the collimator assembly of the present invention

FIG. 6 shows a perspective view of an exemplary alignment fixture 72 used to assemble the collimator assembly 22. The view is oriented from below looking upward at the underside of the alignment fixture 72. In the exemplary embodiment illustrated, the alignment fixture 72 is made from three main parts: a body 74, a first end cap 76, and a second end cap 78, each of which is machined from stainless steel. Other materials which are stable and machinable may be used. Also, the components of the alignment fixture 72 could be arranged differently, or the alignment fixture could be a one piece integral structure. The body 74 is a generally planar and includes inner and outer edges 80 and 82, a top surface 84 (see FIG. 7), and a bottom surface 86. A plurality of ribs 88 are formed in the bottom surface 86. The ribs 88 are disposed in three rows 90, 92, and 94. The spaces between the ribs 88 have a width approximately equal to the thickness of the collimator plates 30. The spaces have a slight taper in the vertical direction to ease installation of the collimator plates 30. The ribs 88 are disposed in a radial array, that is, each of the ribs 88 is aligned along a line extending from the focal spot 14 of the X-ray source 12. Accordingly, the ribs 88 are not parallel to each other. On the contrary, they diverge from the inner edge 80 to the outer edge 82 so as to match the intended positioning of the collimator plates 30. The body 74 also includes slots 96 formed through its thickness to allow access to the collimator assembly 22 and the wires 70 during the assembly process so that adhesive can be applied to the needed areas.

The first end cap 76 has a horizontal portion 98 and a vertical portion 100. The two portions define a generally L-shaped cross section. A slot 102 is formed in the first end cap 76 to allow access to the collimator assembly 22 during the assembly process. The horizontal portion 98 of the first end cap has a bottom surface 97 which protrudes below the bottom surface 86 of the body 74. The lower part of the vertical portion 100 includes a radially facing internal surface 104. A pair of pads 108 are formed on opposite ends of the internal surface 104. The pads 108 contact the outer edges 38 of the bar sections 28 during assembly. Also, a locating rib 110, used to position the alignment fixture 72 in the circumferential direction during the assembly process by engaging slots 41 in the outer edge 38 of the bar sections 28, is formed in the center of the internal surface 104. The horizontal portion 98 of the first end cap 76 is attached to the outer edge 82 of the body 74, for example with cap screws 112 and dowel pins 114 (see FIG. 7).

A second end cap is generally in the shape of a rectangular bar. The second end cap 78 is attached to the inner edge 80 of the body 74, for example with cap screws 118 and dowel pins 120. The second end cap 78 has a bottom surface 116 which protrudes below the bottom surface 86 of the body 74. This bottom surface 116 works in conjunction with the bottom surface 97 of the first end cap 76 to properly position the alignment fixture 72 in the vertical direction with respect to the arcuate base 27, as explained more fully below.

Figure 7:
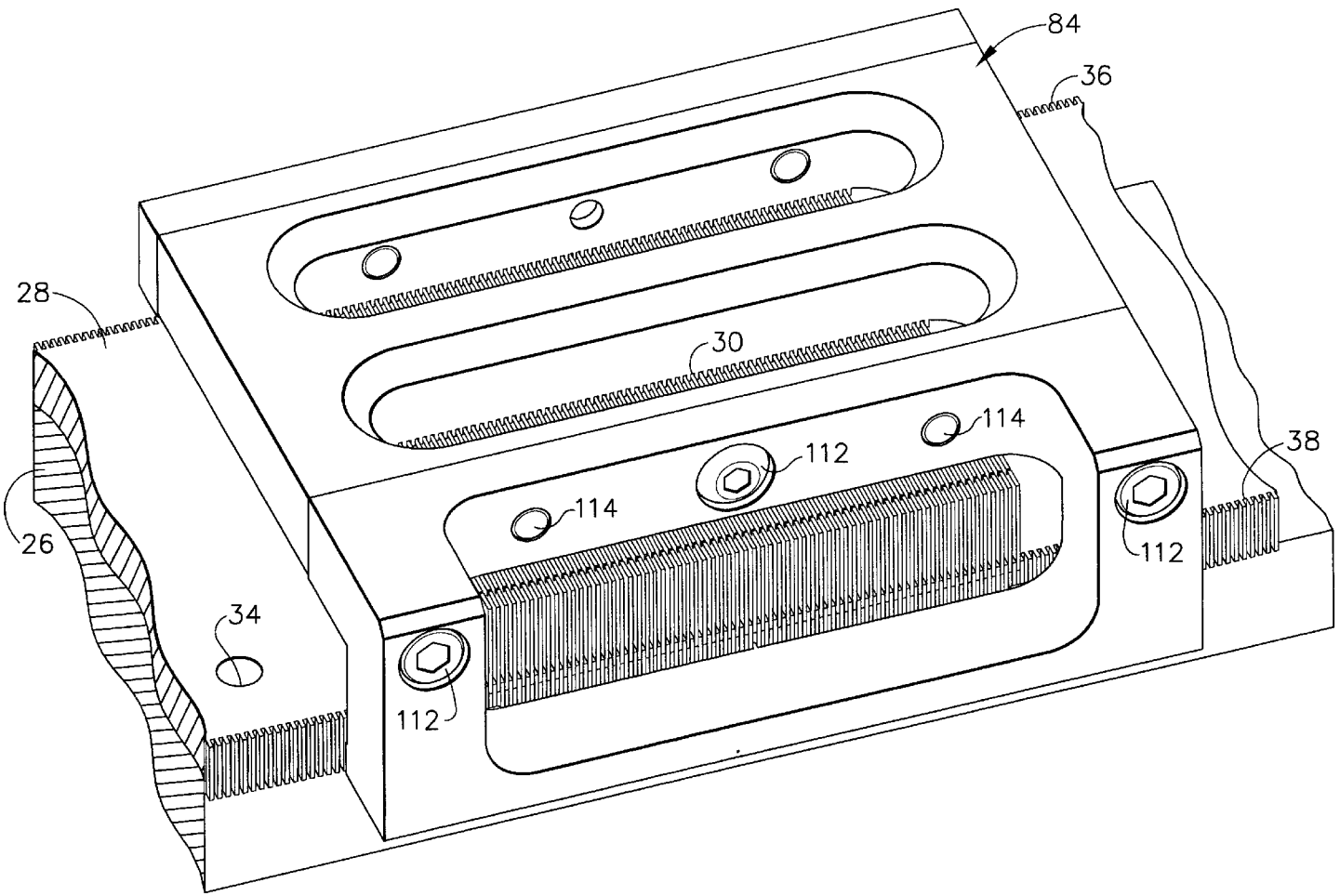
FIG. 7 is a perspective view of the collimator assembly of FIG. 2 in conjunction with the alignment fixture of FIG. 6.

The assembly process of the collimator assembly 22 is now explained in detail with reference to FIG. 7. First, the bar sections 28 are placed on the carrier 26. The bar sections 28 are located in the proper position by means such as dowel pins 34 (see FIG. 2) which pass through holes in the bar sections 28 and the carrier 26. If desired, the bar sections 28 could also be attached to the carrier 26 by known means such as fasteners or adhesives (not shown). After the bar sections 28 are placed on the carrier 26, their top surfaces 37 are ground flat, using a known process, to provide a continuous, planar, arcuate surface 32. The collimator plates 30 are then placed in a radial array on top of the bar sections 28. The first and second alignment tabs 64 and 66 of the collimator plates 30 are received into the slots 40 and 41, in the inner and outer edges 36 and 38 respectively, of the bar sections 28. This ensures that the collimator plates 30 have the proper radial alignment and have the correct plate-to-plate spacing.

The alignment fixture 72 described above is used to square and align the collimator plates 30, one section at a time. Beginning at the center of the collimator assembly 22, after the collimator plates 30 are placed on the surface 32, the wires 70 are laid over the notches 68 in the upper edges 60 of the collimator plates 30. The alignment fixture 72 is then placed on top of the collimator plates 30. The ribs 88 on the bottom surface of the alignment fixture 72 engage the upper edges 60 of the collimator plates 30. This ensures that the collimator plates 30 are in the proper radial alignment and that the individual plates are not "racked" with respect to each other, that is, each of the collimator plates 30 is perpendicular to the surface 32. The bottom surface 97 of the first end cap 76 and the bottom surface 116 of the second end cap 78 both rest on the upper edges 60 of the collimator plates 30. The dimensions of the alignment fixture 72, specifically the distances between the bottom surfaces 97 and 116 of the end caps and the bottom surface 86 of the body 74, are selected to position the alignment fixture 72 in a vertical direction with respect to the arcuate base 27 such that the collimator plates 30 will not fully engage or "bottom out" in the spaces between the ribs 88, in order to prevent binding and distortion of the collimator plates 30. The alignment fixture 72 is pushed in the radially inward direction, causing the locating rib 110 to engage one of the slots 41 in the outer edge 38 of one of the bar sections 28, and thus position the alignment fixture 72 in the circumferential direction with respect to the arcuate base 27. The pads 108 bear against the outer edges 38 of the bar sections 28 to prevent rocking of the alignment fixture 72.

After the alignment fixture 72 is installed, the wires 70 are pushed down into the notches 68 in the upper edges 60 of the collimator plates 30. With the collimator plates 30 and the wires 70 are disposed in the proper position, the collimator plates 30 are secured to the bar sections 28, and the wires 70 are secured to the collimator plates 30, for example using a known industrial adhesive. One example of a usable adhesive is Loctite 499 thermal cycling adhesive gel, available from Loctite Corporation, 1001 Troutbrook Crossing, Rocky Hill, Conn. 06067. Other methods could also be used to secure the collimator plates 30 and the wires 70, for example, brazing or tack welding. The wires 70 are generally continuous for the entire length of the collimator assembly 22 and are therefore secured to the collimator plates 30 one section at a time, with the excess wire length hanging free, to be secured to a subsequent section of collimator plates 30.

After the initial section of collimator plates 30 are secured to the base 27, the alignment fixture 72 is removed and the process described above is repeated using additional groups of collimator plates 30, working from the center of the assembly outward, until the entire collimator assembly 22 is complete. This system of modular assembly allows the construction of collimators of arbitrarily large sizes while maintaining precision and with reasonable assembly costs. This system also reduces the material costs of the collimator assembly 22 itself, because the use of the reusable precision alignment fixture 72 minimizes the amount of precision machining required in the components of the collimator assembly 22.

The foregoing has described a collimator comprising a carrier having a planar top surface; an arcuate base disposed on the carrier, comprising at least one arcuate bar section made from a radio-opaque material; and A plurality of radio-opaque collimator plates disposed on the arcuate base in a radial array with a bottom edge of each collimator plate in contact with the top surface of the arcuate base. The foregoing has furthermore described a method for assembling such a collimator, as well as an alignment fixture useful for practicing the described method. While specific embodiments of the present invention have been described, it will be apparent to those skilled in the art that various modifications thereto can be made without departing from the spirit and scope of the invention as defined in the appended claims.

What is claimed is:

1. A method of constructing an X-ray collimator assembly, comprising:

providing a carrier having a planar top surface;

providing an arcuate base disposed on said top surface of said carrier, said arcuate base comprising an arcuate bar section, said bar section comprising a radio-opaque material and having an arcuate inner edge, an arcuate outer edge, and a planar top surface spaced away from a planar bottom surface, each of said inner and outer edges including a plurality of parallel grooves formed therein extending from said top surface to said bottom surface;

providing a plurality of radio-opaque collimator plates, each of said plates being generally rectangular and having first and second alignment tabs extending downward from a bottom edge thereof, disposing said plurality of collimator plates on said arcuate base so that each of said first alignment tabs fits into one of said grooves in said inner edge of said arcuate base, and each of said second alignment tabs fits into one of said grooves in said outer edge of said arcuate base, such that said collimator plates are positioned in a radial array with respect to said arcuate base, and said bottom edge of each collimator plate is in contact with said top surface of said arcuate base;

aligning said plurality of collimator plates perpendicular to said top surface of said arcuate base; and securing said collimator plates to said arcuate base.

2. The method of constructing an X-ray collimator assembly of claim 1 further comprising:

providing at least one circumferentially extending wire, said wire being received in at least one notch formed in an upper edge of each of said collimator plates; and securing said wire to said plurality of collimator plates.

3. The method of constructing an X-ray collimator assembly of claim 1 wherein said collimator plates are secured to said arcuate base using an adhesive.

4. The method of constructing an X-ray collimator assembly of claim 2 wherein said wire is secured to said plurality of collimator plates using an adhesive.

5. The method of constructing an X-ray collimator assembly of claim 1 further comprising providing additional arcuate bar sections, wherein each bar section has first and second circumferential edges, and the adjoining circumferential edges of adjacent bar sections extend in a direction which is not parallel to a line defining a radius of said arcuate base.

6. The method of constructing an X-ray collimator assembly of claim 1 wherein said step of aligning said plurality of collimator plates perpendicular to said top surface of said arcuate base includes engaging said plurality of collimator plates with an alignment fixture.

7. An alignment fixture for assembling an X-ray collimator which includes a plurality of collimator plates disposed in a radial array on an arcuate base, said alignment fixture comprising:

a body including a plurality of ribs disposed on a bottom surface thereof for engaging said plurality of collimator plates, said ribs being arranged in a pattern corresponding to the desired positioning of said collimator plates; and means for aligning said alignment fixture in a circumferential direction with respect to said arcuate base.

8. The alignment fixture of claim 7 further comprising means for positioning said alignment fixture in a vertical direction with respect to said arcuate base.

9. The alignment fixture of claim 8 wherein said means for positioning said alignment fixture in a vertical direction comprise:

a first end cap disposed at an inner edge of said alignment fixture, said first end cap having a bottom surface disposed a selected distance from said bottom surface of said body; and a second end cap disposed at an outer edge of said alignment fixture, said second end cap having a bottom surface disposed a selected distance from said bottom surface of said body.

10. The alignment fixture of claim 7 wherein said ribs are disposed in a plurality of spaced-apart rows.

11. The alignment fixture of claim 7 wherein at least one access slot is formed through said body.

12. The alignment fixture of claim 9 wherein said first end cap has a horizontal portion and vertical portion, said vertical portion including a radially facing internal surface having an alignment rib formed thereon.

13. An X-ray collimator assembly, comprising:

a carrier having a planar top surface;

an arcuate base disposed on said carrier, said arcuate base comprising at least one radio-opaque arcuate bar section, said bar section having an arcuate inner edge, an arcuate outer edge; and a planar top surface spaced away from a planar bottom surface, each of said inner and outer edges including a plurality of parallel grooves extending from said top surface to said bottom surface; and a plurality of radio-opaque collimator plates disposed on said base in a radial array such that a bottom edge of each of said collimator plates is in contact with said top surface of said base, wherein each of said collimator plates includes first and second alignment tabs protruding downward from a bottom edge thereof, said first alignment tab being received in one of said grooves in said inner edge of said base, and said second alignment tab being received in one of said grooves in said outer edge of said base.

14. The X-ray collimator assembly of claim 13 further comprising a circumferentially extending wire spanning said plurality of collimator plates, said wire being received in a notch formed in a upper edge of each of said collimator plates.

15. The X-ray collimator assembly of claim 13 wherein each bar section has first and second circumferential edges, and the adjoining circumferential edges of adjacent bar sections extend in a direction which is not parallel to a line defining a radius of said arcuate base.

16. The X-ray collimator assembly of claim 13 wherein said collimator plates are secured to said arcuate base using an adhesive.

17. The X-ray collimator assembly of claim 14 wherein said wire is secured to said plurality of collimator plates using an adhesive.

* * * * *